United States Patent [19]

Davis

[11] Patent Number: 4,825,938

[45] Date of Patent: May 2, 1989

[54] ROTATING BLOWOUT PREVENTOR FOR DRILLING RIG

[76] Inventor: Kenneth Davis, P.O. Box 1277, Ruidoso, N. Mex. 88345

[21] Appl. No.: 81,002

[22] Filed: Aug. 3, 1987

[51] Int. Cl.[4] ..... E21B 33/03

[52] U.S. Cl. ..... 166/84; 277/31

[58] Field of Search ..... 166/82, 84, 88, 95; 277/31; 251/1.2

[56] References Cited

U.S. PATENT DOCUMENTS

| | | | |
|---|---|---|---|
| 3,083,973 | 4/1963 | Lucky | 277/31 |
| 4,098,341 | 7/1978 | Lewis | 277/31 X |
| 4,363,357 | 12/1982 | Hunter | 166/84 |
| 4,398,599 | 8/1983 | Murray | 166/95 |
| 4,441,551 | 4/1984 | Bittle | 166/84 |
| 4,500,094 | 2/1985 | Bittle | 277/31 |
| 4,529,210 | 7/1985 | Bittle | 277/31 |

*Primary Examiner*—George A. Suchfield
*Assistant Examiner*—William P. Neuder
*Attorney, Agent, or Firm*—Marcus L. Bates

[57] ABSTRACT

A diverter or rotary drill head has a rubber stripper assembly mounted to a stinger flange. An annular retaining collar is releasably received within the upper marginal end of the drill head main body. the retainer collar is axially spaced from a shoulder formed on the main body to form an annular area therebetween within which the stinger flange is rotatably received in low friction relationship. The retainer collar is held in assembled position by a plurality of retractable radially spaced dogs. The dogs are retracted to permit the stripper rubber, stinger flange, and stinger to be lifted free of the main body. This enables repairs to be rapidly and economically effected on the rotating parts of the diverter and provides a seal means by which well blowouts can be diverted away from the drilling rig.

13 Claims, 3 Drawing Sheets

ROTATING BLOWOUT PREVENTOR FOR DRILLING RIG

BACKGROUND OF THE INVENTION

This invention relates to apparatus for use in the art of earth boring and more particularly to rotary drill heads used in drilling oil and gas wells and the like. A rotary drill head diverts flow from the borehole annulus outwardly from the wellbore and provides control over the drilling operation.

As recited in U.S. Pat. No. 4,500,094, to which reference is made for further background of this invention, rotating blowout preventors are known to those skilled in the drilling art, and are usually referred to as RBOPs; or, rotary stripper devices. The drilling of most boreholes of any significance requires at least one high pressure rotary stripper device. The RBOP enables a driving member, such as a drill string, or the kelly of a drill string, to be slidably forced axially therethrough. The RBOP includes a stripper rubber assembly rotatably mounted respective to a main body so that the driving member and stripper rubber assembly rotate in low friction relationship respective to the remainder of the RBOP. At the same time, the drill string can be slidably positioned axially respective to the RBOP as the string is moved axially within the borehole.

The present invention provides an improved, low cost, rotary drill head for diverting flow from a borehole annulus to a mud pit. The drill head has a rubber stripper assembly mounted to a stinger flange which can be removed up through the turntable and set on the derrick floor so that the stripper rubber as well as other parts of the rotary drill head can be field repaired. This enables the rotating parts of the diverter to be economically replaced, and provides a unique diverter heretofore unknown to those skilled in the art.

SUMMARY OF THE INVENTION

A rotary drill head apparatus is used in conjunction with a drilling rig. The apparatus provides a seal between the rotary drill string and the wellbore to contain the pressure of fluid within the wellbore. The rotary drill head apparatus comprises a main body axially aligned with the drill string and spaced therefrom to provide an annulus therebetween. A side outlet is formed in the apparatus by which flow can occur from the borehole annulus to a location removed from the borehole. A circumferentially extending annular shoulder is formed within said main body at a location above said side outlet. The shoulder is arranged in a plane perpendicular respective to the axis of the borehole. A stinger, a stinger flange, a stripper rubber, and a retaining collar are removably received within the main body. Said stripper rubber is removably affixed to the lower face of said stinger flange, and said stinger flange is affixed to the lower end of said stinger. Said retaining collar is of annular construction and is telescopingly received within said main body in spaced relationship respective to said annular shoulder to form an annular bearing cavity within said main body. The stinger flange is rotatably received within the bearing cavity. A lower circumferentially extending annular bearing surface is formed on the stinger flange and bears against the annular shoulder located on the main body.

Said stinger flange is therefore captured between the two annular surfaces, while the stinger is rotatably received in axial aligned relationship within the retaining collar. The retaining collar is telescopingly removed from the main body, thereby enabling the stinger, stinger flange, and stripper rubber to be removed from the axial passageway of the main body of the rotary drill head assembly. This disassembles the entire apparatus and permits it to be easily field repaired.

In the preferred form of the invention, the retainer collar is axially aligned and affixed within the main body by a plurality of circumferentially extending radially spaced dogs. The dogs are supported by the main body and are manipulated into engagement respective to the collar, thereby locking the retainer collar to the main body.

An unobvious aspect of this invention lies in the cooperative action between the stinger flange and retaining collar. When a high pressure gas pocket is penetrated by the drill bit, and the stinger is thrust uphole, the confronting bearing surfaces on the stinger flange and retaining collar are forced into engagement with one another. This tightly seals the upper end of the rotating head assembly and diverts the high pressure flow from the annulus to the side outlet and thereby retains control over the well.

Accordingly, a primary object of the present invention is the provision of a rotating blowout preventor that utilizes an unusual journal means that can be rapidly and easily replaced in the field.

A further object of the present invention is the provision of a high pressure rotary stripper assembly captured within a main body in a novel manner that enables the stripper assembly to be removed from the main body without the necessity of removing the main body from the stack or wellhead.

These and various objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
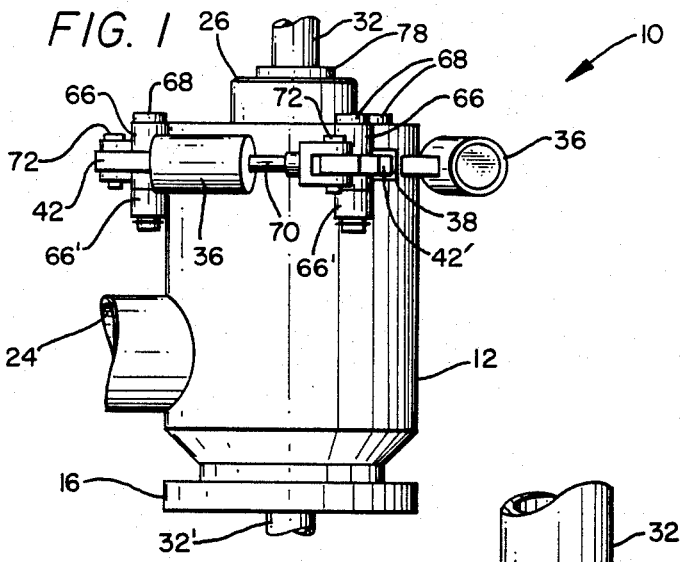
FIG. 1 is a perspective view of a rotary drill head made in accordance with the present invention, with some parts being broken away therefrom.

In FIG. 1 of the drawings, together with other figures thereof, there is disclosed a rotating wellhead 10, sometimes called a diverter, or a rotating blowout preventor, or simply an RBOP. Hereinafter the rotating wellhead 10 will be referred to as a RBOP. As seen illustrated in FIGS. 1–6, the RBOP 10 of the present invention has a massive main metallic body 12 which has been machined into a particular annular configuration of a size that can sometime weigh thousands of pounds. The upper end of the main body (FIGS. 2 and 4) terminates at 14; and the lower end thereof terminates in a flange 16. The RBOP can be attached to a complementary flange 18 such as may be found in a stack of preventors, or the RBOP can simply be attached to the upper end of a well casing 20 (FIG. 6).

Figure 6:
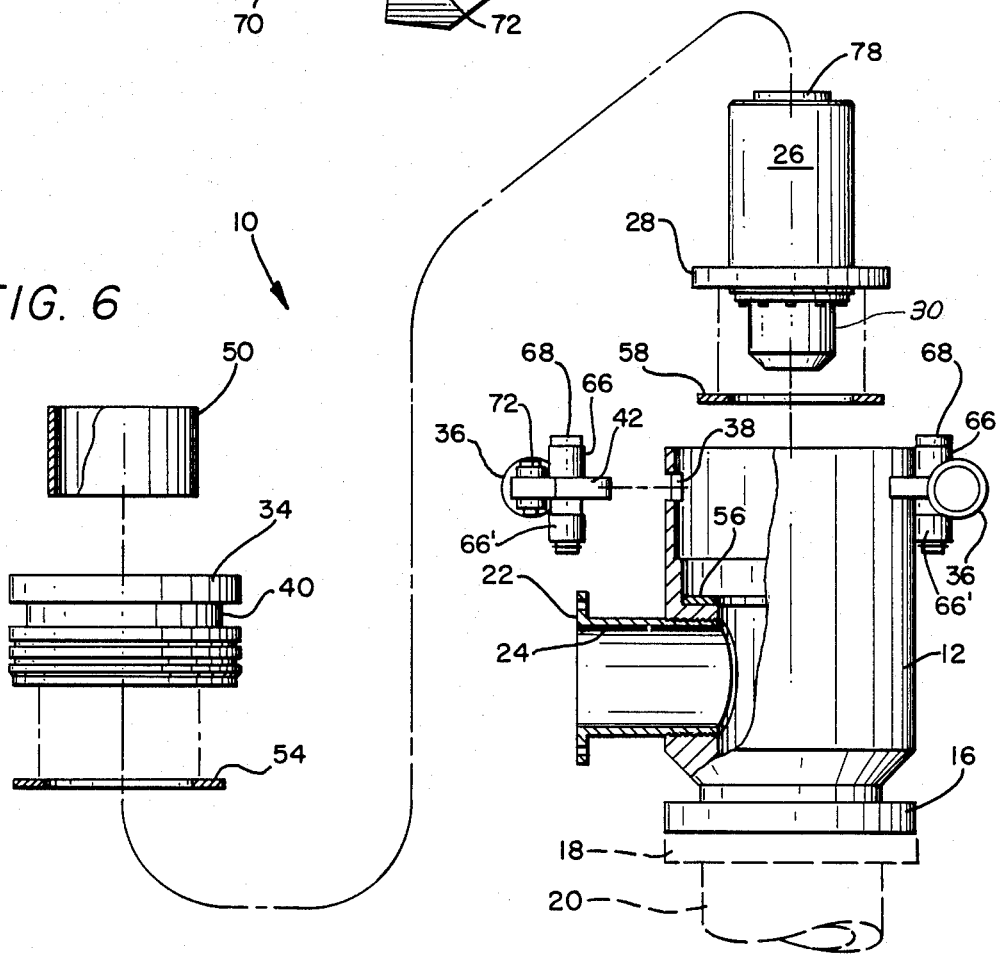

In FIG. 6, the main body 12 is provided with a lateral outlet flange 22 attached at the far end of a lateral side outlet 24. A stinger 26 is rigidly affixed to a stinger flange 28. A stripper rubber assembly 30 is affixed to the stinger flange 28, which in turn is affixed to the stinger 26. Accordingly, the stinger 26, stinger flange 28, and stripper rubber 30 comprise the rotating parts of the RBOP 10.

Figure 2:
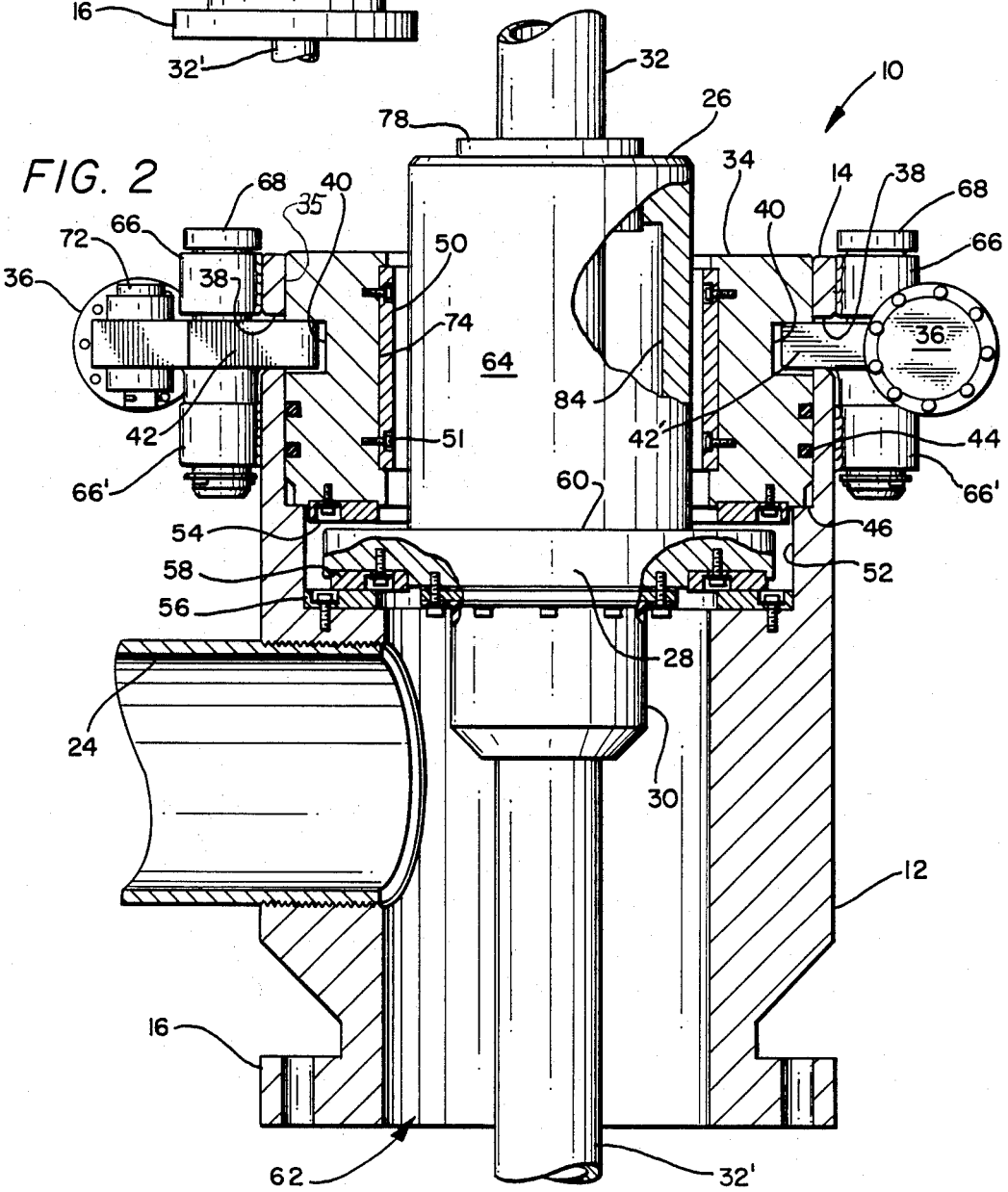
FIG. 2 is an enlarged, longitudinal, part cross-sectional view of the drill head disclosed in FIG. 1.
Figure 3:
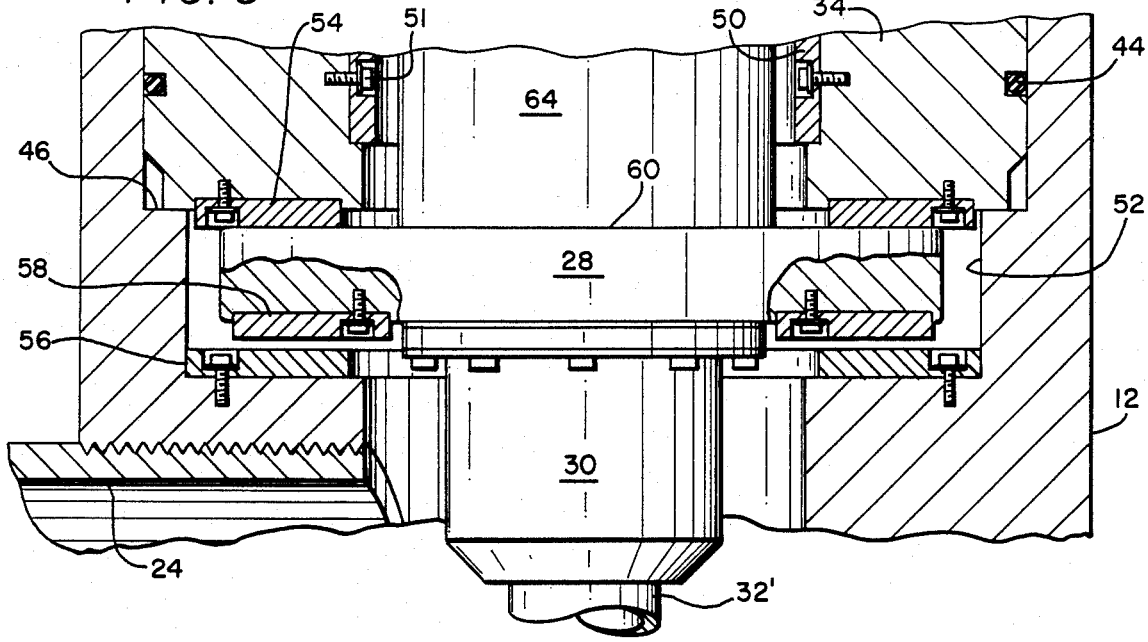
FIG. 3 is an enlarged, fragmentary, part cross-sectional view of part of the apparatus disclosed in FIG. 2.

In FIGS. 1–3, a drive member 32, 32', not forming part of the present invention, extends axially through an axial passageway formed through the RBOP 10. The drive member 32 can be most any part of a string of drill pipe, and usually will be the kelly that is attached to the upper end of the drill string. The drive member 32 rotates and thereby imparts rotational motion into the rotating parts 26, 28, and 30 of the RBOP 10.

Figure 4:
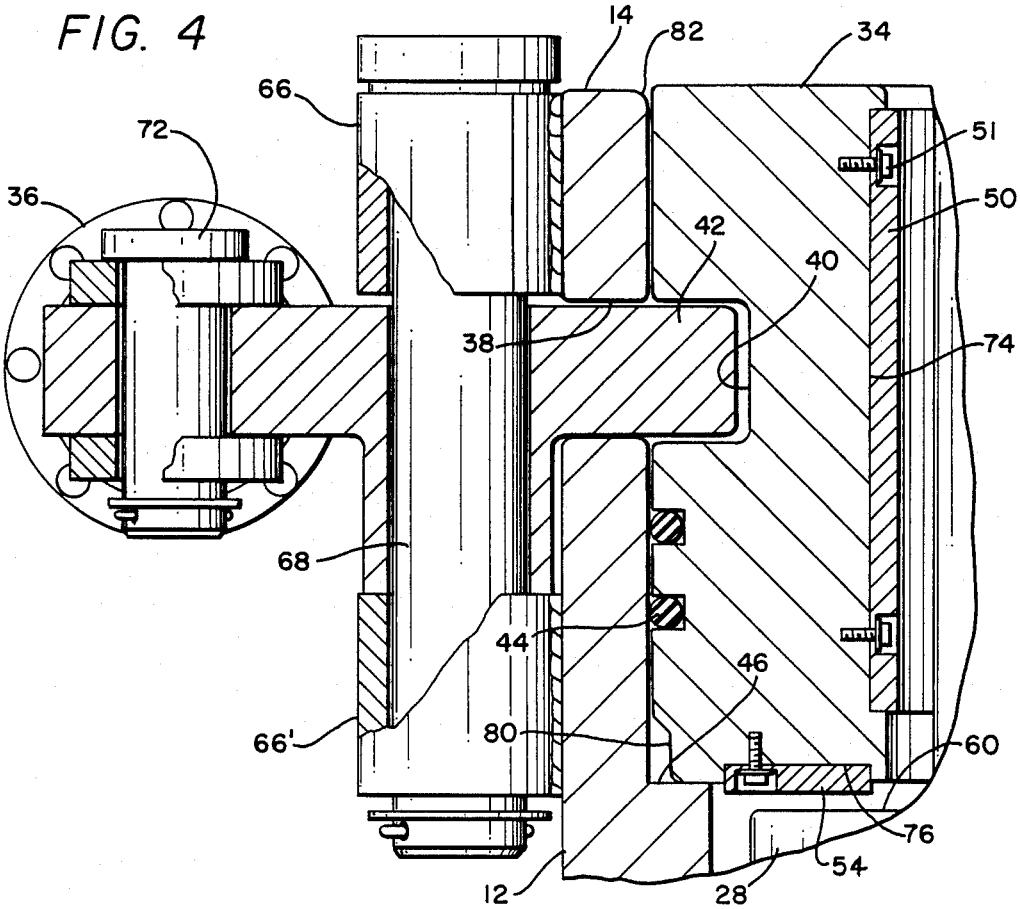
FIG. 4 is a further enlarged, detailed, fragmentary, cross-sectional view of part of the apparatus disclosed in the foregoing figures.
Figure 5:
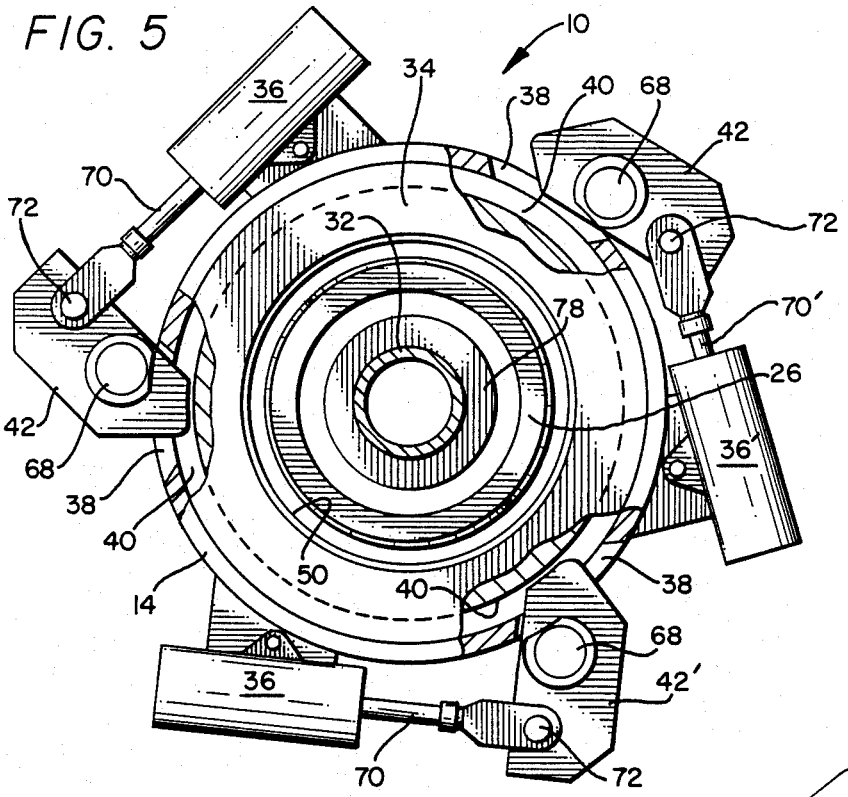
FIG. 5 is a top, plan view of the above apparatus, with some parts being broken away therefrom, and some of the remaining parts being shown in cross-section; and, FIG. 6 is an exploded view of the apparatus disclosed in FIGS. 1–5, with some parts being broken away therefrom and some of the remaining parts being shown in cross-section.

As seen in FIG. 2, together with other figures of the drawings, a retaining collar 34 of annular construction is removably received in fixed relationship within the main body 12. A plurality of retainer means 36, illustrated herein as air actuated dogs, circumferentially extend about the exterior of the main body 12 and form part of the RBOP 10. The upper marginal end of the main body 12 has circumferentially spaced slots 38 oriented in a common horizontal plane that register with a circumferentially extending groove 40 formed within the outer surface of the retaining collar 34. Part of these details are illustrated in FIGS. 4–6. Each of the air actuated cylinders 36 moves a dog 42 through one of the slots 38 and into engagement with the groove 40, thereby removably locking the retaining collar 34 within the upper marginal interior of the main body 12. Spaced o-rings 44 prevent fluid flow along the interface formed between the main body and the retaining collar. Circumferentially extending shoulder 46 is spaced above flange 28 and abuttingly engages the lower outer annular face of the retaining collar 34. The shoulder 46 also separates the retaining collar cavity from the bearing cavity 52.

The inner circumferentially extending surface of the retaining collar 34 is provided with journal means 50 which is fastened into position by any suitable fastener means 51 as deemed desirable. Annular bearing chamber 52 underlies the journal means 50. Annular bearing means 54 is attached by any suitable means to the lower annular face of the retaining collar 34. Annular bearing means 56 is suitably attached to the illustrated lower shoulder of the bearing chamber 52. The lower shoulder of the main body 12 that receives bearing means 56 is opposed to and confronts the bearing means 54 formed on the lower surface of the retaining collar 34.

The rotating stinger flange 28 has a lower outer annular surface that receives an annular bearing means 58. Bearing means 58 bears against bearing means 56. The stinger flange 28 cooperates with the annular shoulder of the main body 12 at 56 to resist a tremendous force as may be required. The upper face 60 of the rotatable flange 28 confronts and can be brought to bear against the bearing means 54 located on the lower face of the stinger 26.

The stinger 26 has an outer bearing surface 64 made with loose tolerance relationship respective to the journal means 50 of the retaining collar 34 and thereby provides a radial bearing surface between the rotating parts of the RBOP which resists lateral thrust from the driving member 32. Accordingly, the tolerance of the coacting surfaces 50, 64 allows for misalignment of the drill string with the borehole. Moreover, the coacting surfaces 54, 60 are arranged slightly spaced from one another; so that, the coacting bearing means 56, 58 normally ride in contact with one another, the bearing means 54, 60 usually are slightly spaced apart from one another, while the bearing means 50, 64 contact one another as may be required to impart lateral stability into the rotating drill string 32. The drill string can therefore move side ways without any resistance until the stinger outside diameter 64 contacts the bearing surface 50 of the retaining collar 34.

In FIGS. 2, 4, and 6, the air actuated cylinder 36 is seen to be provided with means by which it is pivotally mounted to the main body 12, while hinge parts 66, 66' are mounted directly to the main body in a manner to accommodate a pivot pin 68 received therethrough. Pin 68 pivotally supports the before mentioned dogs 42, so that the dogs can be manipulated from the retracted into the extended position of operation. As best seen in FIG. 5, actuator arm 70 has been reciprocated into the extended position by the air actuated cylinder apparatus 36. The far end of the arm is pivotally mounted to the dog 42 by means of small pivot pin 72, which is spaced from large pivot pin 68. This cooperative action extends the marginal end of the dog through the slot 38 and into the groove 40 of the retaining collar 34. The dog 42' is illustrated in the retracted position, noting that arm 70' is retracted, by way of illustration. All of the dogs are either retracted or in the latched position 42.

As best seen in FIGS. 2 and 4, a recess 74 is formed within the inner wall surface of the retaining collar within which bearing 50 is received. The bearing 50 can be of integral construction and slidably received within the recess 74, or it can be segmented so that it can be received within the recess 74. In FIG. 4, the lower face of retaining collar 34 is recessed at 76 to receive bearing 54 therewithin.

In FIGS. 1, 2, 5, and 6, numeral 78 indicates a kelly drive bushing, which can take on any number of different forms, by which the driving member 32 rotatably drives the upper end of the stinger 26 and thereby drives all of the rotating parts of the RBOP 10. Alternatively, the stinger 26 can be connected to be rotated by the turntable of the drilling rig so that the turntable directly drives the rotating parts of the RBOP 10. This is easily accomplished to those skilled in the art in several different well known manners.

In FIG. 4, numeral 80 indicates a reduced diameter lower end of the retaining collar which facilitates introduction of the collar into the collar counterbore formed in the upper marginal end of the main body 12. Numeral 82 indicates the chamfered entrance into the counterbore which is formed into the top 14 of the main body 12. Numeral 84 of FIG. 2 indicates the inside peripheral wall surface of the stinger assembly 26 through which the driving member 32 extends.

In operation, the RBOP 10 of the present invention is attached to the upper end 18 of a stack, or of a casing 20, by attaching flanges 16 and 18 to one another in the usual manner. The novel air actuated cylinders 36 of the RBOP 10 are usually in the extended configuration, with the dogs locking the retaining collar 34 within the main body 12. The air actuated cylinders 36 are preferably spring loaded so that they remain urged into the extended configuration as seen in FIGS. 2 and 4, and on the left side of FIG. 5.

A drill string 32 is run down through the longitudinal axial passageway of the main body 12, which coincides with the longitudinal axis of the casing 20. The stripper rubber 30, which can take on any number of different forms, sealingly engages the driving member 32 and conducts fluid flow from borehole annulus 62 into the lateral passageway 24 and to a location removed from the borehole, such as the mud pit, for example.

When the string 32 is set down, the kelly extends axially through the interior main body 12 and is therefore sealingly engaged by the rubber stripper 30. Rotation of the kelly rotates the string and drives the rotating parts of the RBOP by means of the kelly drive bushing 78. This action rotates the stinger 26, stinger flange 28, and stripper rubber 30. Normally, as the kelly is forced downhole, the confronting lower bearing surfaces 56, 58 engage one another. As the kelly is lifted uphole, the upper surface 60 of the stinger flange 28 engages the upper annular bearing surface 54. During the drilling of the borehole, should an increase in pressure be encountered within the borehole annulus 62, the pressure differential between annulus 62 and ambient will tend to lift the stinger flange 28 so that the upper bearing surface 60 is forced against the bearing surface 54, thereby sealing the bearing chamber 52 from ambient. During normal operation, the bearing surfaces 56, 58 rotatably engage one another in low friction relationship, thereby sealing the lower end of the bearing chamber. As the hole deviates from true vertical, the stinger outer wall surface 64 rotatably engages the circumferentially extending bearing surface 50 and thereby resists side loads.

Whenever it is necessary to extend a large outside diameter part of a drill string through the RBOP, wherein the large outside diameter part has an outside diameter which precludes it being forced through the stripper rubber 30, the air actuated cylinders are moved to the released or retracted position, thereby unfastening the annular retainer collar 34 from the main body 12. This allows the retainer collar, along with the stinger, stinger flange, and stripper rubber to be lifted from the main body 12 of the RBOP, and provides access to the borehole. It is, of course, possible to lift the annular retaining collar 34 from the main body 12, leaving the rotating parts 26, 28, and 30 within the main body should it become desirable to do so.

When the time arrives to replace the stripper rubber 30, the air actuated cylinders are moved to the release position seen at 42' on the right hand side of FIG. 5. The kelly can be lifted up into the derrick carrying the stinger, stinger flange, stripper rubber, and retaining collar therewith so as to enable access to and replacement of the stripper rubber 30. This is accomplished by removing the bolts from the illustrated bolt circle underlying the flange 28 so that a new stripper rubber can readily be substituted for the old one. At the same time, the bearings 54, 58, 56, and 50 can be inspected and replaced as may be required. These bearing surfaces preferably are comprised of Oilon bearing material.

The present invention provides a means by which high pressure fluids can be controlled by diverting the fluids from the borehole annulus to a mud pit or to atmosphere or water. The present invention provides a massive flange 28 which is upthrust against a large bearing surface 54 that can withstand enormous loads. The novel retaining collar 34 is releasably latched into operative position with a unique latch assembly comprised of dogs 42 which can easily be designed to withstand any anticipated downhole pressure. The massive retaining collar 34 cooperates with a cylindrical stinger 26 and accepts side loads or lateral forces encountered during the drilling process in a unique and unusual manner. The interface formed between the stinger 26 and bearing 50 can be made as close tolerance as desired. The massive retaining collar 34 is easily aligned axially with the main body 12 so that when one is drilling a straight hole, there is hardly any lateral forces exerted against bearing surfaces 50 and 64 at all. On the other hand, the retaining collar 34, with or without the rotating parts of the blowout preventor, are easily removed from the main body so that any part of the RBOP can be field repaired, thereby avoiding the ardious task of removing the massive main body 12 from the stack and replacing the main body with another overhauled RBOP.

It is contemplated that the retainer means 36 can take on many different forms, including a clamp as set forth in the prior art patents, a flange having a bolt circle, and other means as may be desired; however, it is believed novel to capture a retainer collar respective to a main body 12 with radially arranged dogs 42 in the illustrated manner of the drawings. Furthermore, it is believed novel to provide a collar 34 having a bearing surface 54 spaced from a main body shoulder 56 in order to provide a bearing chamber 52 within which an annular flange 28 is received for supporting a stripper rubber 30 and a stinger 26. Other points of novelty reside in a RBOP 10 made in accordance with the present invention.

The stinger flange normally rotates against the lower bearing 56 to provide a rotating seal at 56, 58 which restrains low annular pressure at 62. Upon increased downhole pressure upthrusting the string, the stinger and flange are forced uphole until surfaces 54, 60 sealingly contact one another in a manner similar to the action of surfaces 56, 58. The Oilon plastic journals are viscoelastic and are confined within a recess where it can deform slightly in response to load to thereby enhance its sealing characteristics. Accordingly, as the downhole pressure increases, the rotating seal presented by the bearing surfaces is enhanced, thereby providing safety against well blow-outs.

The size and composition of the various components of the RBOP can be judiciously selected to provide control for any anticipated downhole pressure.

Three dogs spaced 120° apart can be made to handle any downhole pressure because the dogs would have to be sheared off in order to fail and the stripper rubber will be extruded uphole before properly designed dogs fail.

The tolerances required between the coacting parts of the RBOP are so generous that the cost of manufacturing can be substantially reduced.

I claim:

1. A rotating blowout preventor having a main body adapted to be affixed to the upper end of a cased borehole, a central axial passageway formed through the body so that a rotatable driving member can extend through the passageway and into a borehole; the improvement comprising:

a rubber stripper assembly having a flange affixed at the upper end thereof and a stripper rubber affixed at the lower end thereof, said stripper assembly and said flange are rotatable respective to said main body, said flange has opposed faces;

means on said main body forming a upwardly directed annular bearing surface within said axial passageway which is perpendicularly oriented respective to the longitudinal axis of the rotating blowout preventor; a lateral outlet underlying said annular bearing surface for flow of fluid from said passageway to a location removed from said main body;

the lower annular face of said flange extends outwardly of said stripper rubber and bears against the annular bearing surface with said stripper rubber underlying said flange and spaced from the interior wall surface of the axial passageway;

a retaining collar received within the upper marginal end of the axial passageway; said collar has a lower annular face positioned in confronting relationship respective to said bearing surface, said flange is received between the lower face of the collar and the bearing surface with there being journal means interposed between the upper flange face and the collar lower annular face and between the lower flange face and the bearing surface;

a stinger connected to said flange, said stinger has an axial passageway formed therethrough that is concentric respective to the axial passageway formed through the collar and the main body; said collar has an inner wall surface against which the outer wall surface of the stinger is received in journaled relationship therewith;

and means for removably affixing said collar respective to said main body; whereby, said collar can be removed from said main body, and the rotating parts of the head can be removed from the main body to thereby enable field repairs to be carried out.

2. The rotating blowout preventor of claim 1 wherein a medial length of said main body axial passageway is enlarged to form said annular bearing surface, and a marginal length of said main body axial passageway is enlarged to form an annular shoulder at a location above said annular bearing surface against which the lower end of the collar is abuttingly received.

3. The rotating blowout preventor of claim 1 wherein said annular bearing surface is an enlarged diameter part of said axial passageway that forms a shoulder within said main body, the lower face of said flange is supported on said bearing surface; the lower face of said collar bears against the upper face of said flange when the rubber stripper assembly is forced uphole; and said stinger bears against the inner peripheral wall surface of the collar and maintains axial alignment between said collar, stinger, flange, and main body.

4. The rotating blowout preventor of claim 1 wherein said collar has a circumferentially extending groove formed thereabout, a plurality of radial pockets are formed through the upper marginal end of the main body and registers with the collar groove;

a retractable dog is mounted on said main body for extending through said radial pockets into the collar groove to thereby anchor the collar within the main body, and means for moving the dog from an extended into a retracted position;.whereby, retraction of the dogs from the collar groove enables the collar to be lifted from the main body passageway.

5. The rotating blowout preventor of claim 1 wherein the upper end of said rubber stripper is removably affixed to the lower face of said flange in aligned relationship respective to said axial passageway, said flange extends outward from said rubber stripper to form said annular bearing surface.

6. A rotating blowout preventor for use in a drilling rig for forming boreholes; said rotating blowout preventor has a lateral outlet for diverting flow from the borehole annulus, said rotating blowout preventor has a main body, and, an axial passageway formed therein through which a rotatable drill string is sealingly and slidably received in axial aligned relationship therewith;

a circumferentially extending axially aligned shoulder formed within said main body, said shoulder being positioned perpendicularly respective to the longitudinal axis of said main body;

and rotating parts within said axial passageway comprised of a stripper rubber, a stinger flange, and a stinger all affixed together and aligned along the longitudinal axis of said main body;

said shoulder is concentric with respect to the longitudinal axis of the main body and perpendicular thereto; said stinger flange has a lower annular face that engages the shoulder in low friction relationship therewith, said stripper rubber is affixed to the lower face of said flange in spaced concentric relationship respective to said shoulder; said flange is affixed to said stinger;

and a retaining collar removably affixed within said passageway of said main body, said collar has a lower face which is brought into engagement with the upper face of said flange in low friction relationship therewith;

whereby, the lower face of said collar is spaced from said shoulder and forms an annular circumferentially extending cavity therebetween within which said flange is rotatably received in captured relationship therewith so that a driving member, such as the drill string, can be extended through said passageway and through said stinger, flange, and stripper rubber.

7. The rotating blowout preventor of claim 6 wherein said lateral outlet is formed through a wall of said main body at a location below said annular bearing surface through which fluid can flow from the borehole annulus while said stripper assembly is rotated by a driving member.

8. The rotating blowout preventor of claim 6 wherein said annular bearing surface is a shoulder formed on said main body that bears against the lower face of said flange; the lower face of said collar bears against the upper face of said bears against the inner peripheral wall surface of the collar flange when the rotating parts are thrust uphole; said stinger and thereby maintains the rotating parts axially aligned with the main body axial passageway.

9. The rotating blowout preventor of claim 6 wherein said collar has a circumferentially extending groove formed thereabout, a plurality of radial pockets are formed through the upper marginal end of the main body and registers with the collar groove;

a retractable dog is mounted on said main body for extending through said radial pockets into the collar groove to thereby anchor the collar within the main body, and means for moving the dog from an extended into a retracted position; whereby, retraction of the dogs from the collar groove enables the collar to be lifted from the main body axial passageway.

10. A rotating blowout preventor having a stationary main body, an axial passageway extending through said main body through which a rotating drive member can extend; a rubber stripper assembly, said stripper assembly is positioned in journaled relationship within said axial passageway and can rotate respective to said main body, an axial passageway extending through said rubber stripper assembly for non-rotatably receiving a drive member in sealed relationship therethrough so that the stripper assembly rotates about the longitudinal axial centerline thereof; the improvement comprising:

said main body includes a reduced diameter bore formed at the upper marginal end thereof that forms an upwardly directed shoulder, said shoulder is perpendicularly arranged respective to the longitudinal axis of said main body;

a retaining collar removably received within the upper marginal and of said main body, said retaining collar having a lower annular face, means mounting said collar at a location which is spaced from said shoulder of said main body and forms a bearing chamber between the shoulder, main body, and lower annular face of the collar;

bearing means formed on said shoulder and on the lower face of said collar;

a flange having opposed faces, an annular stinger affixed to one face of said flange, said stripper assembly being affixed to the other face of said flange, said collar has an axial passageway formed therethrough, the inside wall surface of the axial passageway of the collar cooperates with the outside wall surface of said stinger in low friction relationship therewith;

said stripper rubber is attached to the lower face of said flange in spaced relationship respective to said shoulder; whereby a driving member can extend through said stinger, flange, and stripper rubber and concurrently rotate said stripper rubber, flange, and stinger.

11. The blowout preventor of claim 10 wherein said lateral outlet is formed through a wall of said main body at a location below said annular bearing surface through which fluid can flow from the borehole annulus while said stripper assembly is rotated by a driving member.

12. The blowout preventor of claim 10 wherein said annular bearing surface on said main body bears against the lower face of said flange; the lower face of said collar bears against the upper face of said flange when the rotating parts are thrust uphole; said stinger bears against the inner peripheral wall surface of the collar and thereby maintains the rotating parts axially aligned with the main body axial passageway.

13. The blowout preventor of claim 10 wherein said collar has a circumferentially extending groove formed thereabout, a plurality of radial pockets are formed through the upper marginal end of the main body and registers with the collar groove;

a retractable dog is mounted on said main body for extending through said radial pockets into the collar groove to thereby anchor the collar within the main body, and means for moving the dog from an extended into a retractable position; whereby, retraction of the dogs from the collar groove enables the collar to be lifted from the main body axial passageway.

* * * * *

UNITED STATES PATENT AND TRADEMARK OFFICE

CERTIFICATE OF CORRECTION

PATENT NO. : 4,825,938

DATED : MAY 2, 1989

INVENTOR(S) : KENNETH (NMI) DAVIS

It is certified that error appears in the above-identified patent and that said Letters Patent is hereby corrected as shown below:

In the Abstract, line 5, substitute --The-- for "the".

Column 8, line 61, delete "bears against the inner peripheral wall";

Line 62, delete "surface of the collar" before "flange"

Line 63, insert -- bears against the inner peripheral wall surface of the collar -- after "stinger".

Column 9, line 28, substitute --end-- for "and".

Signed and Sealed this

Thirtieth Day of January, 1990

*Attest:*

JEFFREY M. SAMUELS

*Attesting Officer* *Acting Commissioner of Patents and Trademarks*